United States Patent [19]

Lininger

[11] 3,944,756

[45] Mar. 16, 1976

[54] ELECTRET MICROPHONE

[75] Inventor: Thomas C. Lininger, New Buffalo, Mich.

[73] Assignee: Electro-Voice, Incorporated, Buchanan, Mich.

[22] Filed: Mar. 5, 1975

[21] Appl. No.: 555,411

[52] U.S. Cl. ..... 179/111 E; 179/111 R; 179/1 A

[51] Int. Cl.[2] ..... H04R 19/04

[58] Field of Search ..... 179/111 R, 111 E

[56] References Cited

UNITED STATES PATENTS

| | | | |
|---|---|---|---|
| 3,007,012 | 10/1961 | Olson | 179/111 R |
| R28,420 | 5/1975 | Murphy | 179/111 E |

FOREIGN PATENTS OR APPLICATIONS

| | | | |
|---|---|---|---|
| 1,129,183 | 5/1962 | Germany | 179/111 R |
| 881,584 | 11/1961 | United Kingdom | 179/111 R |

*Primary Examiner*—Kathleen H. Claffy
*Assistant Examiner*—George G. Stellar
*Attorney, Agent, or Firm*—Burmeister, York, Palmatier, Hamby & Jones

[57] ABSTRACT

An electret microphone having a head readily assembled within a housing in which an electrically conducting backplate and an air permeable filter member abut each other and form an electrical connection to an electrically conducting pin. The head of the microphone is mounted on a handle containing an electrical connector which engages the pin of the head forming an electrical connection. The handle also contains an amplifier with an F.E.T. transistor electrically connected to the connector, the amplifier having a radio frequency filter, surge filter, and being adapted to function with direct current potentials carried by the microphone cable of greatly varying magnitudes.

12 Claims, 3 Drawing Figures

DUST SCREEN
RESONATOR PLATE
DIAPHRAGM
TEFLON INSULATOR
SEALING RING
BACKPLATE
CONDUCTIVE DAMPING DISK
CABLE
MOUNTING DISK
ZENER ACTION
SURGE PROTECTION
RFI PROTECTION

ELECTRET MICROPHONE

The present invention relates generally to microphones, and more particularly to microphones of the electret type.

Condenser microphones have been known and extensively used for many years. U.S. Pat. No. 3,007,012 to Harry F. Olson entitled DIRECTIONAL ELECTROSTATIC MICROPHONE discloses a type of condenser microphone in which a vacuum tube amplifier is mounted in close proximity to the transducer of the microphone, and the transducer itself includes a vibratile electrically conducting diaphragm and an electrode or backplate mounted in a fixed position with respect to the diaphragm. The high impedance of a condenser type microphone made it desirable and perhaps necessary to provide an amplifier in close proximity to the transducer. Such condenser microphones, as disclosed by Olson, required high voltage power supplies for operation. The advent of the transistor, and particularly the field effect transistor, simplified the amplifier construction and power requirements for the amplifier. U.S. Pat. No. 3,305,638 to Teachout is an example of such a construction.

The power supply for the condenser microphone is eliminated in electret microphone constructions. In an electret microphone, a foil is utilized as the diaphragm for the microphone, and the foil is given a permanent electrical charge, thus eliminating the need for a power supply for the microphone itself. The article of G. M. Sessler and J. E. West entitled "The Foil-Electret Microphone" in the Aug. 1969 Bell Laboratories Record is an example of an electret microphone.

Condenser microphones generally used a perforated backplate and a filter or resistance element behind the backplate in order to provide the proper acoustical damping for the diaphragm. U.S. Pat. No. 3,007,012 to Olson and U.S. Pat. No. 3,108,162 to Schindler illustrating such constructions. In most condenser microphones, the diaphragm is electrically connected to the casing of the microphone, and the presence of a filter mass behind the backplate makes it difficult to make electrical connection to that plate. Accordingly, it is one of the objects of the present invention to provide a condenser type microphone and more specifically an electret microphone constructed in a manner simplifying electrical connection to the backplate of the microphone.

Since it is almost necessary to utilize an amplifier in close proximity to a condenser type microphone, complications are introduced in the assembly processes used to manufacture such microphones. It is a further object of the present invention to provide a microphone in which the transducer may be assembled in a straightforward simple manner and in which electrical connections to the transducer are simple and require no special processes.

Since electret type condenser microphones do not require high voltage power supplies, it is possible to utilize the microphone cable to conduct the necessary power to operate a transistor amplifier in close proximity to the electret transducer itself. However, microphone cables cannot be relied upon to be free of radio frequency interference, free of unwanted voltage surges, or to carry the proper potential for operation of the transistor amplifier. Accordingly, it is a further object of the present invention to provide an electret microphone with an amplifier capable of being powered from a power source applied to the microphone cable which is protected against radio frequency signals picked up by the microphone cable, power surges which may appear on the microphone cable, and excessive potentials for operating the transistor amplifier which may be impressed upon the microphone cable.

In accordance with the present invention, a condenser microphone is provided which has a vibratile electrically conducting diaphragm mounted in spaced relation to an electrically conducting backplate, the backplate abutting an electrically conducting air permeable filter member, and electrical contact means abutting the filter member including a rod and a spiral spring mounted on the rod for maintaining pressure between the rod and the electrically conducting filter member.

In accordance with another feature of the present invention, all of the foregoing elements are mounted in a separate housing which is removably attached to a handle, the handle containing an electrical connector which grips and makes contact with the electrically conducting rod.

In accordance with still another feature of the present invention, the handle contains a transistor amplifier which has an output adapted to be connected to the microphone cable. The microphone cable is electrically connected to a direct current source for powering the transistor amplifier, and the transistor amplifier is provided with protection against radio frequency signals picked up by the microphone cable, potential surges impressed upon the microphone cable, and operating potentials in excess of the required potential for the transistor amplifier.

A preferred embodiment of the present invention is illustrated in the drawings, in which.

Figures 1, 2, 3:
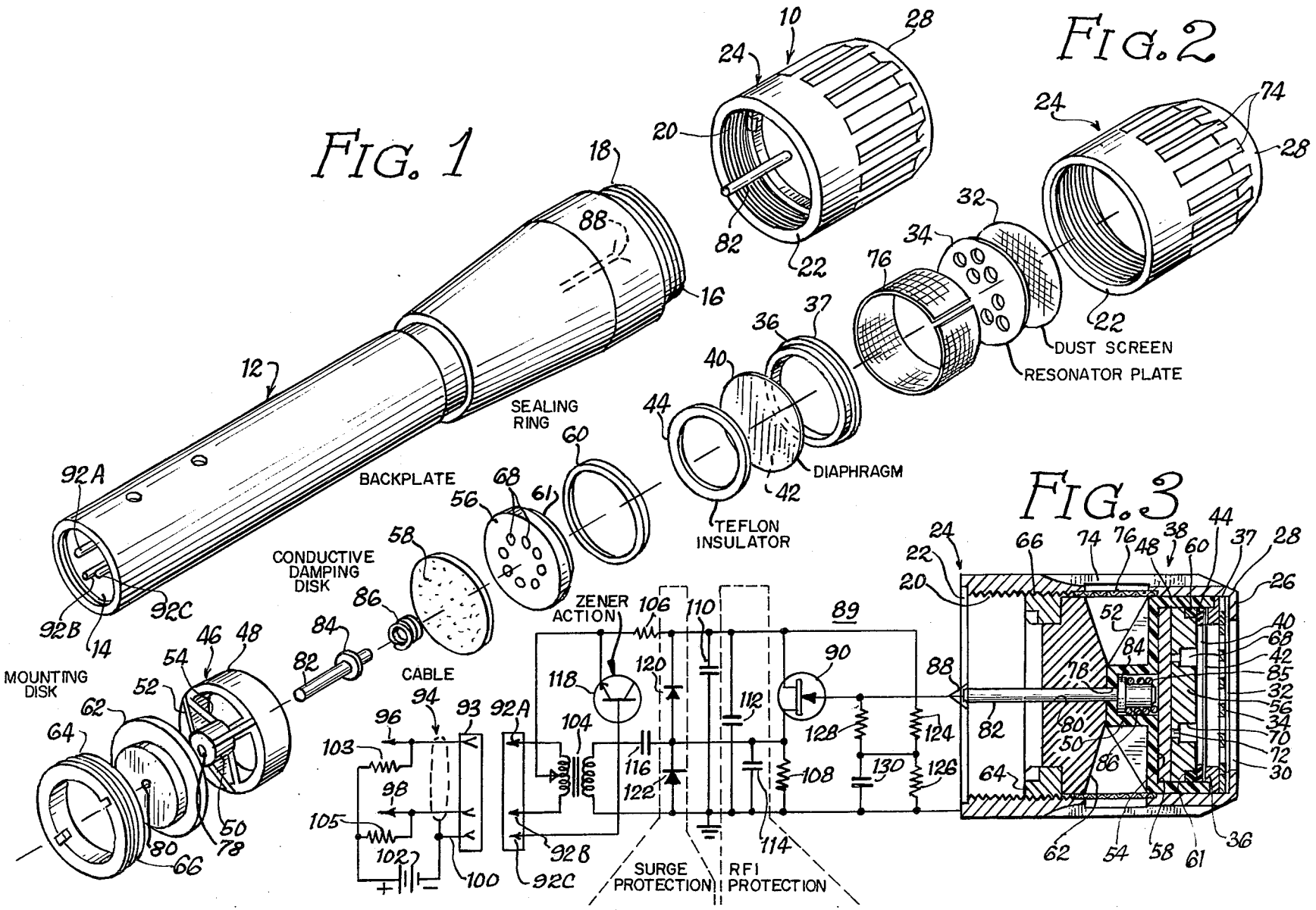
FIG. 1 is an exploded elevational view of a microphone constructed according to the teachings of the present invention.
FIG. 2 is an exploded view of the head of the microphone illustrated in FIG. 1.
FIG. 3 is an axial-section view of the head of the microphone illustrated in FIGS. 1 and 2 and a schematical electrical circuit diagram illustrating the electric circuits used with the microphone.

As illustrated in FIG. 1, the microphone consists of a head 10 and handle 12. The handle 12 has a recess 14 at one end which is adapted to receive a plug and a cylindrical collar 16 extending outwardly from the other end. The collar 16 is provided with external threads 18 which mate with internal threads 20 on a cylindrical open end 22 of a housing 24 for the head 10. The head 10 may thus be screwed upon the collar 16 of the handle 12 to form a unitary structure.

The housing 24 is generally cylindrical in shape and has a wall 26 at its end 28 opposite the end 22. The wall 26 is provided with a cylindrical opening 30 to permit sound waves to enter the interior of the housing 24.

A sereen 32 is mounted in the opening 30 to prevent dirt and dust from entering into the housing, and an electrically conducting perforated resonator plate 34 is mounted in the housing in abutment with the interior surface of the screen 32, and electrically connected to the housing 24 as by a layer of cement, not shown. A ring shaped spacer 36 of electrically conducting material is disposed immediately inward of the resonator 32 and is part of a transducer 38. The transducer 38 is of the condenser type and utilizes a film 40 of plastic material, such as Teflon, mounted on the end of the spacer 36 opposite the resonator plate 34. A layer 42 of electrically conducting material such as silver is disposed on the surface of the film 40 confronting the resonator plate 34, and this layer 42 is electrically connected to the housing 24, which is also constructed of electrically conducting material, through the electrically conducting spacer 36.

A ring 44 of electrical insulating material is mounted in abutment with the plastic film 40 on the side thereof opposite the conducting layer 42. A support member 46 is provided with a cylindrical portion or rim 48 which is slidably disposed within the walls of the housing 24 and encircles the ring 44 and the spacer 36, except for a lip 37 on the end of the spacer which extends over the end of the rim 48.

The support member also has a hub 50 disposed about the axis of the cylindrical portion on the side of the cylindrical portion remote from the film 40, the hub 50 being mounted on the cylindrical portion by three arms 52 disposed at equal angles from each other. Each of the arms has a shoulder 54 disposed on a plane perpendicular to the axis of the cylindrical portion 48. A backplate 56 of electrically conducting material and a damping disc 58 are wedged between the shoulder 54 and the ring 44, a sealing ring 60 being disposed in a circular recess 61 at the perimeter of the backplate in abutment with the ring 44. Pressure is maintained on the backplate 56 and damping disc 58 by means of a mounting disc 62 which is slidably disposed within the housing 24 in abutment with the hub 50, and a locking ring 64 which has external threads 66 which engage the internal threads 20 at the open end 22 of the housing 24.

The backplate 56 is provided with a plurality of channels 68 which extend therethrough from the surface confronting the film 40 to the filtering disc 58. The channels 68 have a portion 70 of larger diameter confronting the film 40 and a portion 72 of smaller diameter confronting the filter disc 58. The channels 68 are arranged in a circle about the center of the circular backplate 56. The damping disc 58 is constructed of electrically conducting porous material such as sintered stainless steel.

The housing 24 has a plurality of spaced vents 74 extending therethrough in a region between the mounting disc 62 and the cylindrical portion 48 of the support member 46. A screen 76 in the form of an elongated strip of perforated metal is disposed within the housing 24 covering the vents 74.

The hub 50 of the support member 46 is provided with an aperture 78 on the axis of the housing 24, and a channel 80 extends through the mounting disc 62 on the axis of the housing 24 in alignment with the aperture 78. An electrically conducting rod 82 is slidably disposed within the aperture 78 and channel 80, and the rod has a protruding collar 84 disposed in a recess 85 in the hub 50 in alignment with the aperture 78, and the collar 84 is in abutment with the surface of the hub 50 which confronts the damping disc 58. A spiral spring 86 is disposed about the rod 82 in the recess 85 in abutment with the surface of the damping disc 58 and the protruding collar 84 of the rod 82, and the spring 86 urges the rod 82 into abutment with the hub 50, electrical contact between the rod 82 and the damping disc 58 being maintained by the spring 86.

The film 40, with its electrically conducting layer 42 forms a capacitor with the backplate 56. The film 40 is flexible and hence forms a vibratile diaphragm which will respond to sound waves passing through the screen 32 and resonator plate 34 to impinge thereon. The film 40 has been electrostatically polarized to function in the manner of an electret so that vibrations of the film 40 in response to sound waves result in an alternating potential being developed between the electrically conducting layer 42 on the film and the backplate 56. These potentials appear on the housing 24 and rod 82, respectively.

The porous damping disc 58 damps back sound waves emanating from the vibratile film 40 and also provides an acoustical impedance to sound waves entering through the vents 74. Back waves are conducted from the vibratile diaphragm 40 to the damping disc 58 through the channels 68, and sound waves entering through the vents 74 are transmitted to the vibratile diaphragm through the damping disc 58 and the channels 68. In addition, the large diameter portion 70 of each channel 68 contributes to the volume of the diaphragm chamber which is that volume within the spacer 44 between the film 40 and the backplate 56. Sound waves entering through the vents 74 have the effect of providing a directional cardioid response pattern for the microphone.

FIG. 1 illustrates the rod 82 protuding from the casing 24. When the casing 24 is screwed onto the handle 12, the rod 82 is gripped securely by and makes electrical connection with a connector shown at 88 in FIGS. 1 and 3 and rigidly mounted within the handle 12. When the head 10 is screwed on the handle 12, the pin 82 is translated against the spring 86 into abutment with the damping disc 58, but vibration, shock, or temperature changes in combination with the tension of the spring 86 result in the pin 82 being translated against the hub 50. Electrical contact between the damping disc 58 and the contact 88 is thus maintained through the spring 86 and the rod 82 through shock, vibration, or temperature change.

A field effect transistor amplifier 89 is also mounted within the handle 12, FIG. 3 diagrammatically illustrating this amplifier. The amplifier utilizes a field effect transistor 90 with a control electrode connected to the rod 82 through the connector 88. The amplifier 89 has three terminals 92A, 92B and 92C mounted in the recess 14 at the end of the handle 12, and the terminals 92A, 92B and 92C are adapted to receive the connector 93 of a microphone cable 94. The cable 94 has two leads 96 and 98 and a ground lead 100, and a direct current potential source 102, illustrated as a battery, has a positive terminal connected to the leads 96 and 98, by a pair of resistors 103 and 105, respectively, the negative terminal of the source 102 being connected to the ground lead 100. The terminals 92A and 92B are connected to the output terminals of a transformer 104, and the output winding of the transformer 104 has a central tap which carries the positive potential from the source 102 through a resistor 106 to the source terminal of the field effect transistor 90. The drain terminal of the field effect transistor 90 is connected to the negative terminal of the source 102 through a resistor 108.

The amplifier 89 is provided with a filter capacitor 110 connected between the source terminal of the transistor 90 and the ground terminal in order to provide a substantially ripple-free potential between the source and drain terminals of the transistor. The source terminal is also connected to the common ground terminal through a relatively small capacitor 112, and the drain terminal is connected to the common ground through a second relatively small capacitor 114, the capacitors 112 and 114 protecting the source and drain of the transistor, respectively, from radio frequency currents which may be picked up by the cable 94. Current flowing from the source to the drain of transistor 90 is modulated by the potential on the control or gate terminal resulting in a signal voltage appearing across resistor 108. The signal voltage is conducted to the primary of transformer 104 by a capacitor 116.

The potential applied between the source and drain terminals of the transistor 90 is controlled by the Zener potential of a second junction device or transistor 118, the base of the transistor 118 being connected to the common ground and the emitter of the transistor 118 being connected to the center tap of the output winding of transformer 104. The transistor 90 is protected against potential surges which may be transmitted from the line 94 through the transformer 104 by means of two diodes 120 and 122. The diode 122 is connected between the drain of the transistor 90 and the common ground to pass positive charges toward the drain, and the diode 120 is connected between the drain and source of the transistor 90 to pass positive charges toward the source.

The amplifier 89 not only amplifies the audio signal which appears between the coating 42 on the diaphragm film 40 and the backplate 56, and also transforms the high impedance of this output to a relatively low impedance at the output winding of the transformer 104. It will be noted that the amplifier 89 is physically mounted in close proximity to the transducer 38, thus permitting a relatively short connection through the rod 82 between the backplate 56 of the transducer and the gate electrode of the transistor 90. Since the output of the transformer 104 is of low impedance, the cable 94 may be of any practically desired length.

Since the potential difference developed between the source electrode of the transistor and the common ground is relatively fixed, by virtue of the Zener action of the transistor 118, a resistance network may be utilized to establish the bias potential for the gate electrode of the F.E.T. transistor 90. A resistor 124 is connected in series with a resistor 126 between the source terminal of the transistor 90 and the common ground, and a resistor 128 is connected between the junction of the resistors 124 and 126 and the gate electrode of the transistor 90. A capacitor 130 is connected in parallel with the resistor 126. This network establishes the proper bias for the F.E.T. transistor 90.

The microphone described in FIGS. 1 through 3 may be readily assembled without the need to make any electrical connections in the head of the microphone. In order to assemble the head of the microphone, the screen 32 and resonator plate 34 are placed within the housing 24 in that order. The rod 82 is then inserted through the aperture 78 of the support member 46 and the spring 86 is placed in position on the rod. Thereafter, the damping disc 58 and backplate 56 are slipped within the cylindrical portion 48 of the support member 46 in that order. The sealing ring 60 is then inserted in the circular recess 61, and the spacer 44 is positioned within the cylindrical portion 48 of the support member 46.

A diaphragm assembly is produced on a separate jig consisting of the spacer 36 and film 40 with its electrically conducting coating 42. The diaphragm assembly is then inserted into abutment with the spacer 44, the spacer 36 having a cylindrical recess to permit a portion of the spacer 36 to be disposed within the cylindrical portion 48 of the support member 46.

The screen 76 is then cemented over the vents 74 within the housing 24. Thereafter, the entire assembly within the support member 46 is inserted into the housing 24, the electrically conducting spacer 36 abutting the housing 24 and the resonator plate 34 to provide electrical contact between the electrically conducting coating 42 on the film 40 and the electrically conducting housing 24. The disc 62 is then slipped onto the rod 82, and the locking ring 64 threaded into place to compress the assembly within the housing 24, thereby completing the assembly operation.

The head 10 must only screwed onto the handle 12, thereby providing electrical connection between the housing 24 and the sleeve of the handle and between the rod 82 and the connector 88. Further, movement of the rod with respect to the electrically conducting damping disc 58 will not break electrical connection between the rod and the damping disc because of the presence of the spiral spring 86.

From the foregoing specification, those skilled in the art will readily devise modifications and alternative constructions which are intended to be within the scope of the present invention. It is therefore intended that the scope of the present invention not be limited by the foregoing specification, but rather only by the appended claims.

The invention claimed is:

1. A capacitor transducer comprising, in combination, an electrically conducting housing having an opening at one end for the passage of sound waves, a vibratile electrically conducting diaphragm mounted within the housing confronting the opening and electrically connected to the housing, an electrically conducting plate mounted within the housing on the side of the diaphragm opposite the opening and electrically insulated from the housing, said plate having a flat surface disposed parallel to and spaced from the diaphragm, the perimeter of said plate being acoustically sealed on the housing, and said plate having a plurality of channels extending therethrough to permit sound waves to pass through the plate, an acoustic damping member disposed within the housing and abutting the surface of the plate opposite the diaphragm, said member being constructed of electrically conducting porous material and being electrically insulated from the housing, a support member of electrically insulating material disposed within the housing confronting the acoustic damping member on the side thereof opposite the electrically conducting plate, electrical contact means mounted on the support member and abutting the acoustic damping member including an electrically conducting pin and a spring mounted on the pin for maintaining pressure between the pin and the damping member.

2. A capacitor transducer comprising the combination of claim 1 wherein the support member has a hub disposed confronting the acoustic damping member, said hub having an aperture extending therethrough, the pin being slidably journalled in the aperture and having a protruding collar confronting the side of the hub confronting the acoustic damping member, the spring being electrically conducting and in the form of a spiral disposed about the pin between the collar thereof and the acoustic damping member.

3. A capacitor transducer comprising the combination of claim 2 wherein the support member has a rim disposed between the perimeter of the plate and acoustic damping member and the housing, and a plurality of spaced arms extending between one end of the rim and the hub, each of said arms having a shoulder disposed in abutment with the acoustic damping member.

4. A capacitor transducer comprising the combination of claim 3 wherein the rim of the support member extends about the perimeter of the diaphragm, the diaphragm being mounted on an electrically conducting ring and extending across the one side thereof, said ring having an outwardly protruding lip from the side thereof opposite the film, and the lip abutting the end of the rim opposite the arms, said rim also extending about a spacer disposed between the ring and the plate.

5. A capacitor transducer comprising the combination of claim 4 wherein the hub is provided with a recess extending therein from the acoustic damping member and forming a shoulder about the aperture in the hub, the spiral spring being disposed about the pin within the recess of the hub.

6. A capacitor transducer comprising the combination of claim 5 wherein the housing has a cylindrical open end provided with internal threads and the pin is disposed on the axis of said end, said housing having means at the opposite end thereof for restraining the support member, diaphragm and ring against motion from the open end of the housing, in combination with a retaining ring having outwardly extending threads engaging the threads in the open end of the housing and a mounting member between the hub and the retaining ring.

7. A capacitor transducer comprising the combination of claim 6 wherein the housing is provided with a vent confronting the hub of the support member.

8. A microphone comprising a capacitor transducer as set forth in claim 6 in combination with a handle having a cylindrical open end provided with external threads mating with the internal threads of the open end of the transducer housing, and a connector mounted within the handle engaging the pin and making electrical contact therewith.

9. A microphone comprising the combination of claim 8 wherein the diaphragm comprises a plastic film with an eletrically conducting coating on the surface of said film opposite the plate, said film being electrostatically charged to form an electret, in combination with an amplifier mounted within the handle of the microphone having a field effect transistor with a source electrode, a drain electrode and a gate electrode, the gate electrode being electrically connected to the connector of the transducer, said amplifier having a first, a second, and a third output terminal adapted to be connected to a microphone cable having a ground wire at one direct current potential and two signal wires at different approximately equal potentials with respect to the ground wire respectively, the amplifier having a resistor connected between the first output terminal and the drain electrode of the transistor, said amplifier having a transformer with an input winding coupled to opposite ends of a resistor and an output winding connected to the second and third output terminals, said output winding having a center tap electrically connected to the source electrode of the transistor.

10. A microphone comprising the combination of claim 9 in combination with a first and a second diode connected in series, the first diode being connected in parallel with the resistor and the second diode being connected between the source and drain of the transistor, said diodes being connected to pass positive charges from the first terminal.

11. A microphone comprising the combination of claim 9 in combination with a junction device having a base and an emitter, the base being connected to the first terminal and the emitter being connected to the center tap of the output winding of the transformer, whereby the base-emitter Zener threshold and the resistance of the power supply circuit limits the potential applied to the transistor.

12. A microphone comprising the combination of claim 9 in combination with a radio frequency filter comprising a first capacitor connected from the first terminal to the source of the transistor, and a second capacitor connected in parallel with the resistor.

* * * * *